US005381134A

United States Patent [19]

Friday et al.

[11] Patent Number: 5,381,134

[45] Date of Patent: Jan. 10, 1995

[54] STATIC DISCHARGE PROTECTION FOR PROGRAMMING PORTS ASSOCIATED WITH AN ELECTRONIC DEVICE

[75] Inventors: Ronald S. Friday, Jupiter; Brian N. Nover, Boynton Beach; Eric T. Eaton, Lake Worth, all of Fla.

[73] Assignee: Motorola, Inc., Schaumburg, Ill.

[21] Appl. No.: 24,063

[22] Filed: Mar. 1, 1993

[51] Int. Cl.[6] ..... H01R 13/453

[52] U.S. Cl. ..... 340/825.44; 439/138

[58] Field of Search ..... 439/135-137, 439/138, 139, 140, 181; 361/119, 220, 818, 212; 340/825.44; 455/90, 347-349

[56] References Cited

U.S. PATENT DOCUMENTS

| | | | |
|---|---|---|---|
| 3,763,461 | 10/1973 | Kotski | 439/138 |
| 4,422,071 | 12/1983 | de Graaf | 340/825.44 |
| 4,518,961 | 5/1985 | Davis et al. | 540/825.44 |
| 4,847,711 | 7/1989 | Inoue | 439/138 |

FOREIGN PATENT DOCUMENTS

| | | | |
|---|---|---|---|
| 232792 | 8/1987 | European Pat. Off. | 439/138 |
| 1-161683 | 6/1989 | Japan | 439/138 |

*Primary Examiner*—Michael Horabik

*Attorney, Agent, or Firm*—D. Andrew Floam; Gregg E. Rasor

[57] ABSTRACT

An electronic device (300) has a housing (301) forming a cavity that enshrouds a circuit supporting substrate (302) having at least one electrical contact (303) coupled to a conductor (304). The conductor (304) couples an electrical signal between the electrical contact (303) and electronic circuitry (305) associated with the circuit supporting substrate (302). An aperture (306) in the housing (301) provides access to the at least one electrical contact (303). An articulable cover (307) contiguous to a surface (310) of the housing (310) blocks the aperture (306) when the electronic device (300) is disengaged from a peripheral device (308).

20 Claims, 2 Drawing Sheets

STATIC DISCHARGE PROTECTION FOR PROGRAMMING PORTS ASSOCIATED WITH AN ELECTRONIC DEVICE

FIELD OF THE INVENTION

This invention relates generally to static discharge protection in electronic devices, and more particularly, to a mechanical static discharge protector for programming ports on an electronic device.

BACKGROUND OF THE INVENTION

Reliability of operation is an important consideration for modern electronic devices, e.g., selective call receivers. One aspect of reliability is the device's ability to continue to function properly after exposure to an electrostatic discharge, e.g., a spark or the like. Conventional selective call receivers, e.g., pagers, generally include CMOS and bipolar circuits that are relatively sensitive to damage from high voltages such as those associated with an electrostatic discharge.

Various methods have been tried to protect the CMOS and bipolar circuits from damage due to phenomena such as junction breakdown, metal mask failure, or the like, caused by a high voltage electrostatic discharge. An example of two conventional protection schemes that form a low impedance path to ground for high voltages are spark gaps, e.g., closely situated pointed sections of a printed circuit board runner adjacent to a ground runner, or a zener diode. Neither of these alternatives completely protect the sensitive components since the energy associated with the electrostatic discharge has already entered the selective call receiver.

Accordingly, to alleviate the problems associated with electrostatic discharge, an apparatus must be fabricated that effectively isolates the sensitive circuitry within the selective call receiver from the energy contained within the electrostatic discharge, thus eliminating the possibility of damaging the circuitry and insuring continued reliable operation of the selective call receiver.

SUMMARY OF THE INVENTION

Briefly, according to the invention, there is provided an electronic device having a housing forming a cavity that enshrouds a circuit supporting substrate having at least one electrical contact coupled to a conductor that couples an electrical signal between the electrical contact and electronic circuitry associated with the circuit supporting substrate. The electronic device comprises an aperture in the housing through which the at least one electrical contact is accessed and an articulable cover contiguous to a surface of the housing for blocking the aperture when the electronic device is disengaged from a peripheral device.

DESCRIPTION OF A PREFERRED EMBODIMENT

Figure 1:
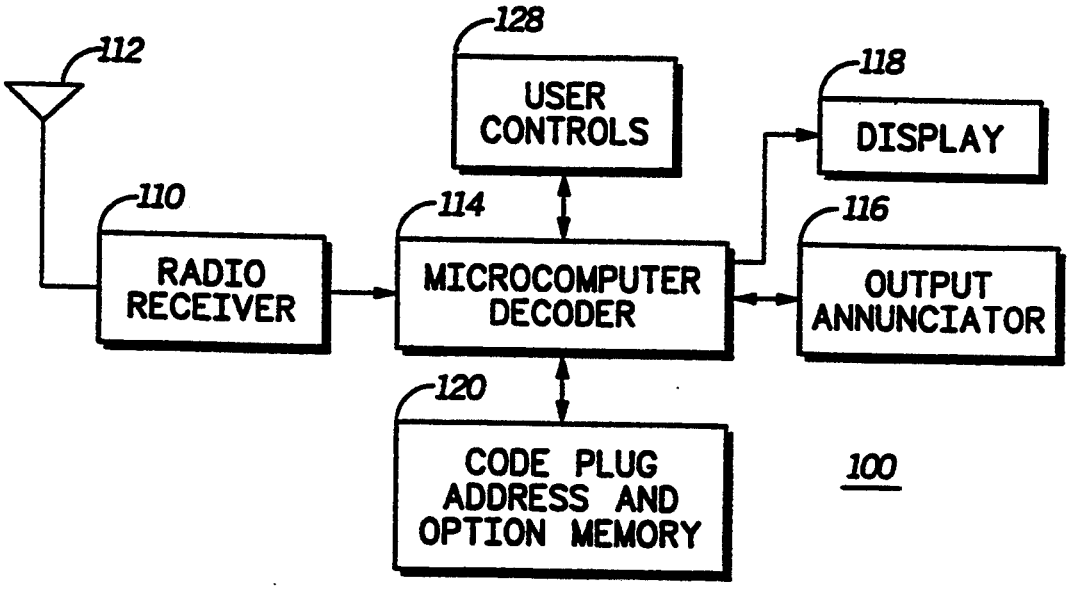
FIG. 1 is a block diagram of a paging receiver in accordance with the preferred embodiment of the present invention.

FIG. 1 is an electrical block diagram of a selective call receiver, e.g. a pager 100. It includes radio receiver circuitry 110 which receives signals via an antenna 112. The received signals include paging information. Selective call receivers can respond to transmitted information containing various combinations of tone, tone and voice, or data messages in a variety of modes. This information may be transmitted using several paging coding schemes and message formats.

The output of the radio receiver circuitry 110 is applied to a microcomputer decoder 114 which processes the information contained in the received signals, to decode any received message. As can be seen, the microcomputer decoder 114 communicates with an output annunciator 116, such as a transducer or speaker, to alert a user that a message has been received, with a display 118, such as a liquid crystal display (LCD), to present a message via the display 118, and with a code plug address and option memory 120 to retrieve predetermined address and function information. Normally, after a received address matches a predetermined address in the pager 100, the output annunciator 116 alerts the user that a message has been received. The user can activate user controls 128, such as buttons or switches, to invoke functions in the pager 100, and optionally to view the received message on the display 118. The operation of a paging receiver of the general type shown in FIG. 1 is well known and is more fully described in U.S. Pat. No. 4,518,961, issued May 21, 1985, entitled "Universal Paging Device with Power Conservation", which is assigned to the same assignee as the present invention and is incorporated herein by reference.

Figure 2:
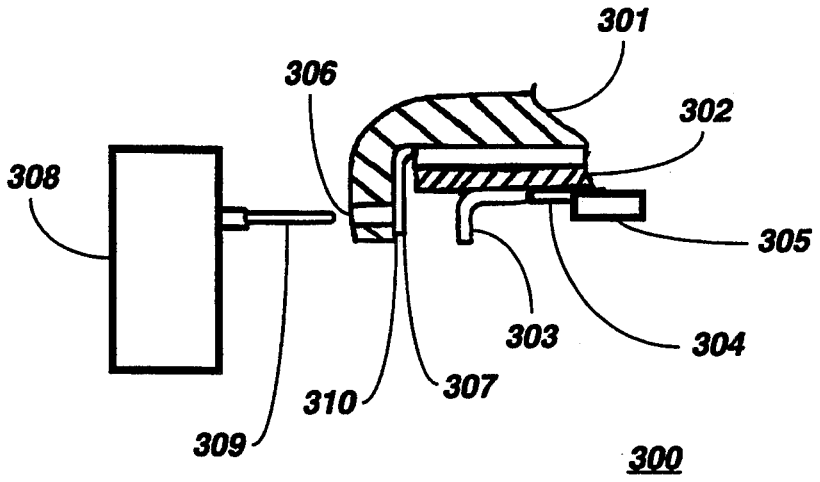
FIG. 2 is a cross-sectional view of a pager housing with the articulable cover blocking a contact aperture in accordance with the preferred embodiment of the present invention.

FIG. 2 is a cross-sectional view of a pager housing with the articulable cover blocking a contact aperture in accordance with the preferred embodiment of the present invention. The electronic device 300 has a housing 301 forming a cavity that enshrouds a circuit supporting substrate 302 having at least one electrical contact 303 coupled to a conductor 304 that couples an electrical signal between the electrical contact 303 and electronic circuitry 305 associated with the circuit supporting substrate 302. An aperture 306 in the housing 301 of the electronic device 300 creates an access port through which the at least one electrical contact 303 may be connected with a peripheral device 308. In normal operation, an articulable cover 307 contiguous to a surface 310 of the housing 301 blocks the aperture 306 when the electronic device 300 is disengaged from the peripheral device 308. The articulable cover 307 serves to prevent an electrostatic discharge from entering the electronic device 300 and damaging the electronic circuitry 305.

In a first embodiment, the articulable cover 307 comprises an elastomeric material having electrical properties associated with an electrical conductor and is electrically connected to a reference potential in the electronic device, thus creating a low impedance electrical path along which the electrostatic discharge will flow to the reference potential, thereby preventing damage to the electronic circuitry contained in the electronic device. In an alternate embodiment, the articulable cover 307 comprises an elastomeric material having electrical properties associated with an electrical insulator and is electrically isolated from the conductor, thus presenting a high electrical impedance to the electrostatic discharge and preventing the electrostatic discharge from entering the electronic device and damaging electronic circuitry contained therein.

Ideally, in both embodiments, the articulable cover 307 sufficiently coheres with the surface 310 of the housing to create a seal that prevents the intrusion of contaminants into the electronic device 300.

Figure 3:
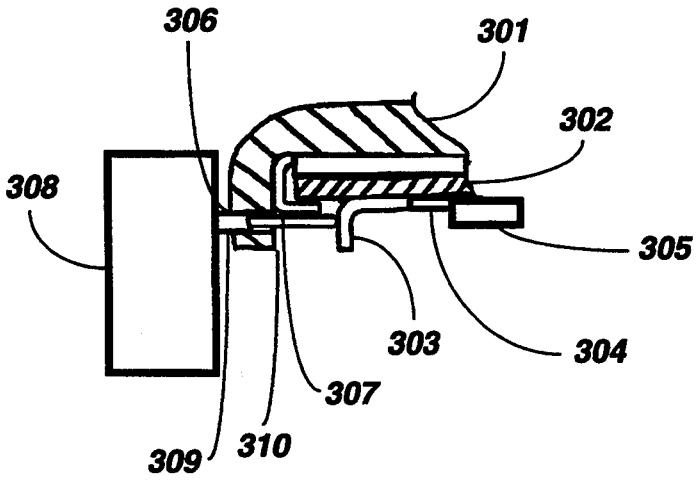
FIG. 3 is a cross-sectional view of a pager housing with the articulable cover forcibly displaced in accordance with the preferred embodiment of the present invention.

FIG. 3 is a cross-sectional view of a pager housing with the articulable cover 307 forcibly displaced in accordance with the preferred embodiment of the present invention. In this figure, the articulable cover 307 is shown forcibly displaced by an external contact 309 when the electronic device is engaged with the peripheral device 308. This allows the external electrical contact 309 to form an electrical connection with the at least one electrical contact 303 and permit communication of the electrical signal between the electronic device 300 and the peripheral device 308.

What is claimed is:

1. An electronic device having a housing forming a cavity that enshrouds a circuit supporting substrate having at least one electrical contact coupled to a conductor that couples an electrical signal between the electrical contact and electronic circuitry associated with the circuit supporting substrate; the electronic device comprising:

an aperture in the housing through which the at least one electrical contact is accessed; and an articulable cover contiguous to a surface of the housing for blocking the aperture when the electronic device is disengaged from a peripheral device, wherein the cover is formed of elastomeric material.

2. The electronic device according to claim 1 wherein the articulable cover is forcibly displaced when the electronic device is engaged with the peripheral device, thus allowing an external electrical contact to form an electrical connection with the at least one electrical contact and permit communication of the electrical signal between the electronic device and the peripheral device.

3. The electronic device according to claim 2 wherein the articulable cover is forcibly displaced by the external electrical contact.

4. The electronic device according to claim 1 wherein the elastomeric material is electrically conductive.

5. The electronic device according to claim 4 wherein the articulable cover is electrically connected to a reference potential in the electronic device, thus creating a low impedance electrical path along which the electrostatic discharge will flow to the reference potential, thereby preventing damage to the electronic circuitry contained in the electronic device.

6. The electronic device according to claim 1 wherein the elastomeric material is electrically insulative.

7. The electronic device according to claim 6 wherein the articulable cover is electrically isolated from the conductor, thus presenting a high electrical impedance to the electrostatic discharge and preventing the electrostatic discharge from entering the electronic device and damaging electronic circuitry contained therein.

8. The electronic device according to claim 1 wherein the articulable cover sufficiently coheres with the surface of the housing to create a seal that prevents the intrusion of contaminants into the electronic device.

9. The electronic device according to claim 1 wherein the electronic device is a radio receiver.

10. The electronic device according to claim 1 wherein the peripheral device is an electronic programmer.

11. A selective call receiver for receiving transmitted messages, the selective call receiver having a circuit supporting substrate and at least one electrical contact coupled to a conductor that couples an electrical signal between the electrical contact and electronic circuitry associated with the circuit supporting substrate, the selective call receiver comprising:

a housing forming a cavity that enshrouds the circuit supporting substrate;

electronic circuitry, at least a portion of which is coupled to the circuit supporting substrate, including at least one of:

receiving means for receiving a message comprising an address;

decoding means coupled to the receiving means for decoding the received message, and for determining if the received address matches a predetermined address; and alert means coupled to the decoding means for generating an alert if the received address matches the predetermined address;

an aperture in the housing through which the at least one electrical contact is accessed; and an articulable cover contiguous to a surface of the housing for blocking the aperture when the electronic device is disengaged from a peripheral device, wherein the cover is formed of elastomeric material.

12. The selective call receiver according to claim 11 wherein the articulable cover is forcibly displaced when the selective call receiver is engaged with the peripheral device, thus allowing an external electrical contact to form an electrical connection with the at least one electrical contact and permit communication of the electrical signal between the selective call receiver and the peripheral device.

13. The selective call receiver according to claim 12 wherein the articulable cover is forcibly displaced by the external electrical contact.

14. The selective call receiver according to claim 1 wherein the elastomeric material is electrically conductive.

15. The selective call receiver according to claim 14 wherein the articulable cover is electrically connected to a reference potential in the selective call receiver, thus creating a low impedance electrical path along which the electrostatic discharge will flow to the reference potential, thereby preventing damage to the electronic circuitry contained in the selective call receiver.

16. The selective call receiver according to claim 11 wherein the elastomeric material is electrically insulative.

17. The selective call receiver according to claim 16 wherein the articulable cover is electrically isolated from the conductor thus presenting a high electrical impedance to the electrostatic discharge and preventing the electrostatic discharge from entering the selective call receiver and damaging electronic circuitry contained therein.

18. The selective call receiver according to claim 11 wherein the articulable cover sufficiently coheres with the surface of the housing to create a seal that prevents the intrusion of contaminants into the electronic device.

19. The selective call receiver according to claim 11 wherein the peripheral device is an electronic programmer.

20. An electronic device having a housing forming a cavity that enshrouds a circuit supporting substrate having at least one electrical contact coupled to a conductor that couples an electrical signal between the electrical contact and electronic circuitry associated with the circuit supporting substrate; the electronic device comprising:

an aperture in the housing through which the at least one electrical contact is accessed; and an articulable cover formed of elastomeric material mounted to the housing without additional hardware so that a portion thereof extends contiguous to a surface of the housing suitable for blocking the aperture when the electronic device is disengaged from a peripheral device.

* * * * *